US007093786B2

(12) United States Patent
Wisniewski

(10) Patent No.: US 7,093,786 B2
(45) Date of Patent: Aug. 22, 2006

(54) TAKE-UP CORES FOR FLEXIBLE MATERIALS AND METHODS

(75) Inventor: William Wisniewski, Omaha, NE (US)

(73) Assignee: First Data Corporation, Greenwood Village, CO (US)

( * ) Notice: Subject to any disclaimer, the term of this patent is extended or adjusted under 35 U.S.C. 154(b) by 126 days.

(21) Appl. No.: 10/793,249

(22) Filed: Mar. 3, 2004

(65) Prior Publication Data

US 2005/0194490 A1 Sep. 8, 2005

(51) Int. Cl.
*B65H 75/24* (2006.01)

(52) U.S. Cl. ..... 242/571; 242/573.4

(58) Field of Classification Search ..... 242/571, 242/407.1, 573, 573.1, 572, 573.4, 577
See application file for complete search history.

(56) References Cited

U.S. PATENT DOCUMENTS 2,338,513 A * 1/1944 Helm ..... 242/571
2,952,418 A * 9/1960 Rice ..... 242/573.9
4,245,795 A * 1/1981 Ludszeweit et al. ..... 242/553
4,500,044 A * 2/1985 Schnell ..... 242/527.6
6,155,517 A * 12/2000 Lippold et al. ..... 242/571.5
6,508,433 B1 * 1/2003 Jeans ..... 242/577

FOREIGN PATENT DOCUMENTS

CH 641741 A * 3/1984
FR 2555560 A1 * 5/1985

* cited by examiner

*Primary Examiner*—Kathy Matecki
*Assistant Examiner*—Sang Kim
(74) *Attorney, Agent, or Firm*—Townsend and Townsend and Crew LLP

(57) ABSTRACT

In one embodiment, a take up reel comprises a core having a generally open interior and an outer surface that is adapted to hold a sheet-like material that is wound around the core. Also, the core defines at least one slot. A slider member is slidable within the slot between a home position and an extended position away from the outer surface. In this way, when the sheet-like material is wound around the outer surface of the core when the slider member is in the extended position, the sheet-like material is spaced apart from the core in the region of the slot. Further, when the slider member is moved to the home position, the tension in the wound sheet-like material is reduced to facilitate removal of the core.

21 Claims, 6 Drawing Sheets

TAKE-UP CORES FOR FLEXIBLE MATERIALS AND METHODS

BACKGROUND OF THE INVENTION

This invention relates generally to the field of sheet-like materials, such as foils, and in particular to the winding of a sheet-like material around a core, and the removal of the wound material from the core.

Take up reels for holding sheet like materials are used in a variety of applications. One particular example is a tipping machine that transfers foil from a roll of foil onto an embossed card, such as a credit card. Various models of embossing/tipping machines are commercially available from Data Card Corporation, among others.

When collecting the used foil on a take up reel, the foil is tightly wound on the reel. This can be problematic when it is desirable to remove the foil from the take up reel and reuse the reel. In some cases, the reel can be damaged or destroyed when attempting to remove the foil.

BRIEF SUMMARY OF THE INVENTION

In one embodiment, the invention provides a take up reel that permits a sheet-like material to be wound on the reel and then removed, without destroying the reel. The reel comprises a core having a generally open interior and an outer surface that is adapted to hold a sheet-like material that is wound around the core. The core also includes at least one slot. A slider member is slidable within the slot between a home position and an extended position away from the outer surface. The sheet-like material is wound around the outer surface of the core when the slider member is in the extended position. In this way, the sheet-like material is spaced apart from the core in the region of the slot. When the slider member is moved to the home position, the tension in the wound sheet-like material is reduced to facilitate removal of the core.

In one aspect, a pair of ends are coupled to the core. Each end may include an extension that extends into the interior and holds the slider member in the extended position when the ends are coupled to the core. Also, the slider member is movable to the home position when the ends are uncoupled from the core to permit the wound material to be removed.

To help maintain the proper spacing in the slot, a spacer may extend across the interior of the core. Also, the reel may include a pin and a hole may be formed in the slider member. With this arrangement, the pin may extend into the hole and across the interior to hold the slider member in a desired orientation. In one particular aspect, the slider member may comprise a nylon block.

In another aspect, the core may have ends with at least one notch, and the end members may include detents that fit within the notch when the end members are coupled to the core. In this way, the ends will rotate along with the core. In a further aspect, the core may comprise a cylindrical member, and the sheet-like material comprises a foil.

The take up reel may be used with a foil tipping machine having a foil reel containing a length of foil. The tipping machine further includes a card transport system, and a tipping module that is configured to take a card from the card transport system and transfer foil from the length of foil onto the card. The take up reel is positioned to receive the length of foil from the tipping module.

The tipping machine may optionally include a cutter to cut the length of foil prior to reaching the take up reel. In this way, any markings from the credit card can be destroyed by the cutter.

The invention also provides a method for winding a sheet-like material on a take up reel and then removing the sheet-like material from the reel. The method utilizes a take up reel comprising a core having a generally open interior and an outer surface. Also, the core includes at least one slot, and a slider member that is slidable within the slot between a home position and an extended position away from the outer surface. The sheet-like material is wound around the core while the slider member is in the extended position, with the sheet-like material being spaced apart from the core in the region of the slot. The slider member is then moved to the home position to release the tension in the wound sheet-like material. Further, the sheet-like material is removed from the core, such as by sliding it off of the core without damaging the core.

In a further step, both end members may be coupled to the core. The end members have an extension that holds the slider member in the extended position. In another step, the end members are removed prior to removing the sheet-like material from the core to permit the slider member to move to the home position. Also, a desired spacing is maintained in the slot with a spacer that is disposed in the interior of the core. Further, the slider member may be slid over a pin that is positioned in the interior of the core.

Optionally, the sheet-like material may be cut before being wound onto the take up reel. This step is particularly useful when transferring foil from the sheet-like material to a card prior to winding the sheet-like material around the core.

DETAILED DESCRIPTION OF THE INVENTION

In certain aspects, the invention provides a core over which a sheet like material may be wound. During the winding process, a compressive force is applied by the sheet like material against the core, making it difficult to remove the wound material. The cores of the invention are configured so that following winding, the sheet-like material may be easily removed from the core without damaging the core. In this way, the core may be repeatedly reused.

Such a core may be used with a variety of sheet like materials and with various applications. For example, the core may be used to hold foils, plastics, films, fabrics, rope, wires, paper, matting and the like. The cores may be incorporated into essentially any type of reel where sheet like materials are wound including, but not limited to, foil tipping machines, plastics, films, fabrics and the like.

Figure 1:
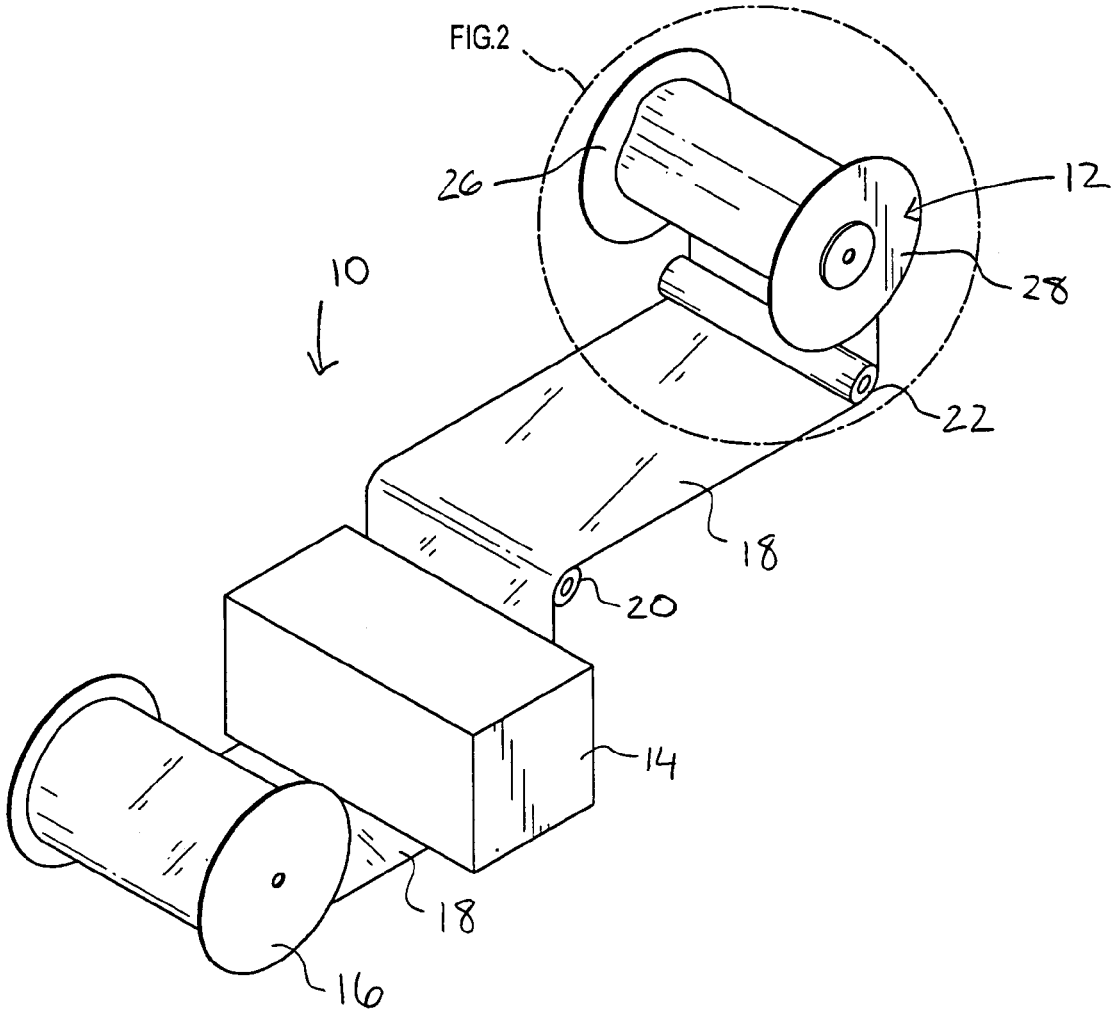
FIG. 1 is a perspective view of a portion of a tipping machine having a take up reel for receiving a length of foil according to the invention.

Referring now to FIG. 1, one embodiment of a tipping machine 10 having a take up reel 12 will be described. Tipping machine 10 is configured to place an amount of foil onto an embossed presentation instrument, such as a credit card, debit card, stored value card or the like. Such instruments (by way of example) may include credit cards, debit cards, gift cards and similar cards. Such financial cards may have a standard size—a lateral length of approximately 3⅜ inches (85 mm), a height of approximately 2⅛ inches (54 mm), and a thickness of approximately 0.03 inches (0.75 mm), pursuant to ISO standards although other sizes may be used as well. When embossed, the cards have raised regions (typically letters and numbers) representing information such as the account number, name and the like. After embossing, the cards are moved into a tipping module 14 (represented schematically). For example, a system of rollers may individually advance the cards in a vertical arrangement through tipping module 14 where a foil is placed onto the embossed characters on the card. This may be accomplished using a reel 16 having a roll of foil 18 that passes through tipping module 14. As the cards pass through tipping module 14, the foil 18 is heated and pressed against the card, causing part of the foil that is in contact with the embossed characters to transfer onto the card. The foil 18 is then removed from the card and advanced so that a fresh length of foil is available to transfer to the next card passing through tipping module 14.

As additional foil is advanced from reel 16, the used foil 18 passes over a roller 20 and then over a roller/cutter 22. Because the used foil 18 may have confidential information, such as a credit card number, roller/cutter 22 may be configured to cut foil 18 into two or more sections before being taken up on reel 12.

Both reels 12 and 16 are rotatably mounted to the tipping machine 10 so that they are free to rotate about their central axis. Also, one or more motors and a controller may be used to rotate the reels in order to advance foil 18 through tipping module 14.

Figure 2:
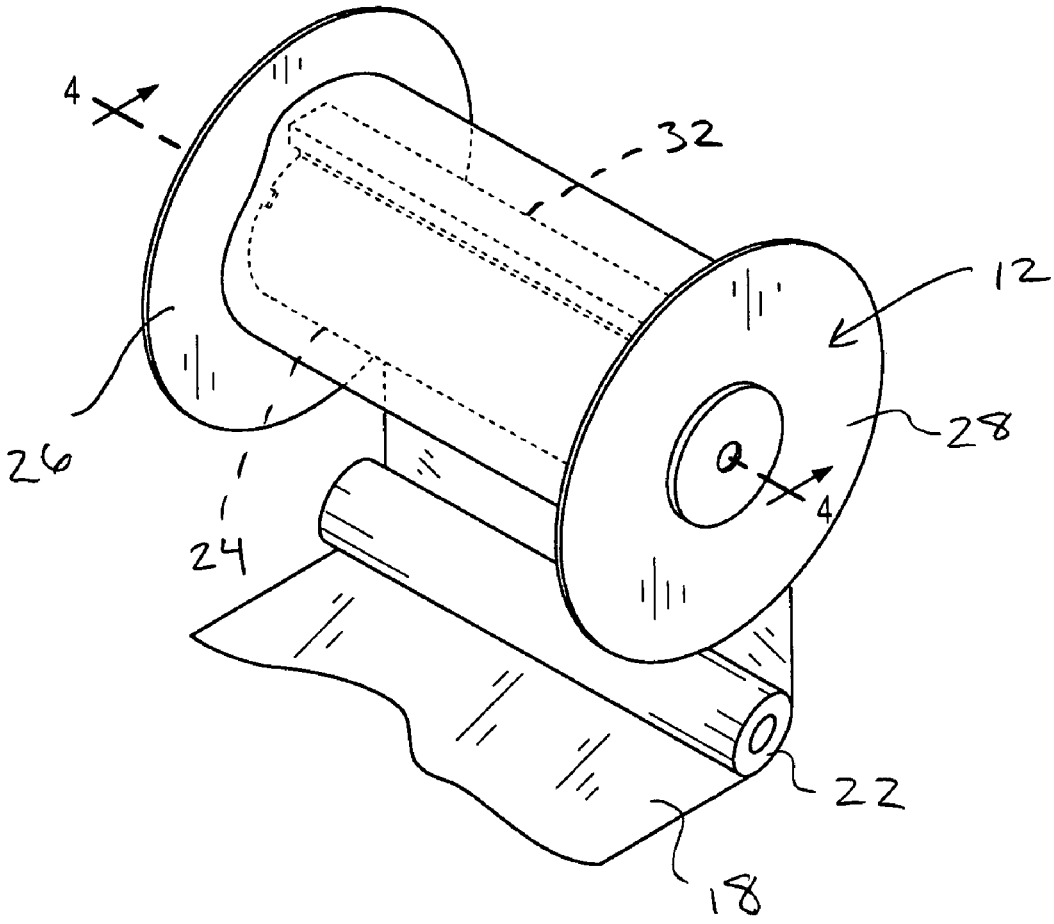
FIG. 2 is a more detailed view of the take up reel of FIG. 1.
Figure 3:
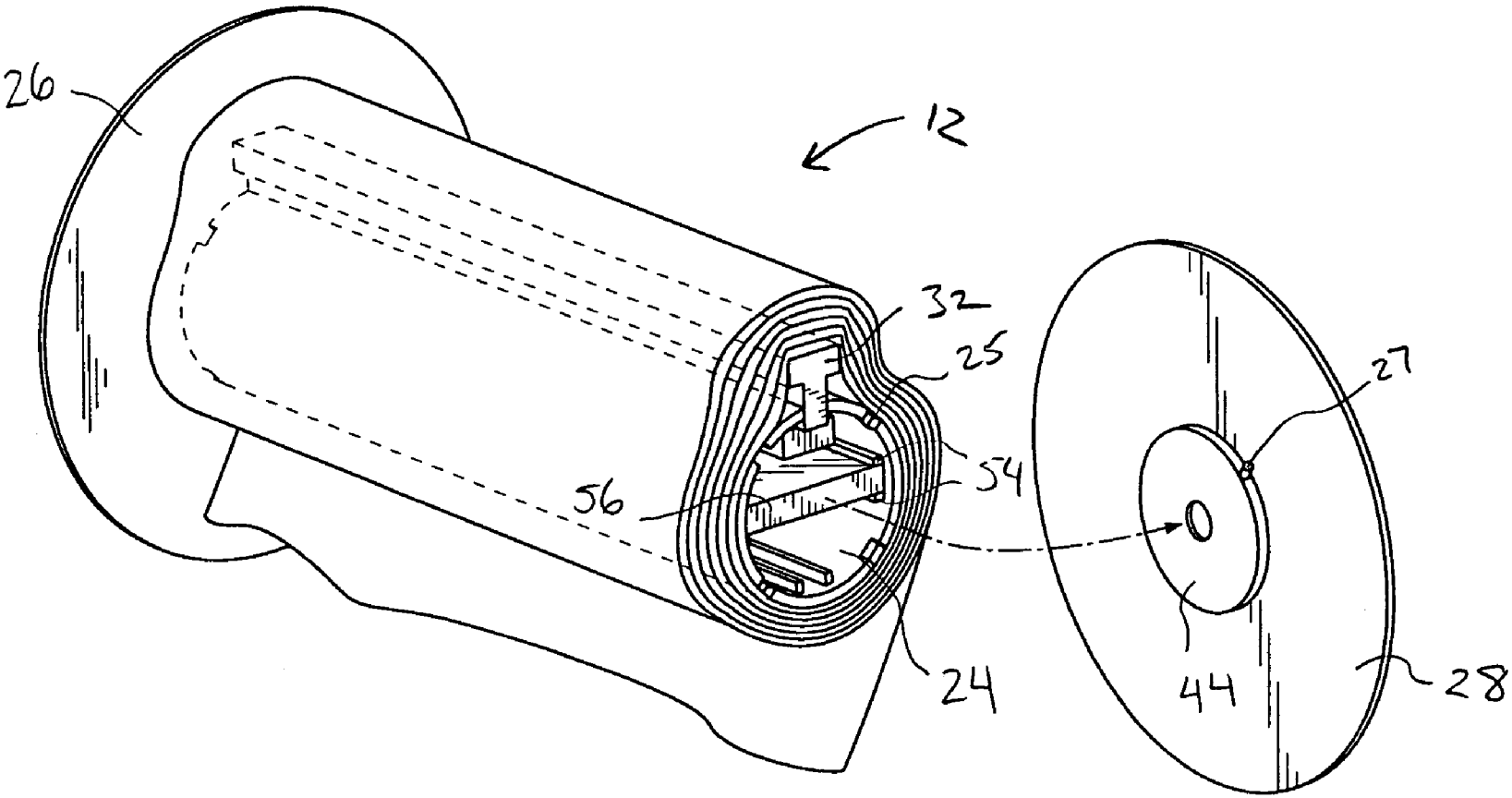
FIG. 3 is illustrates the reel of FIG. 2 with one of its ends removed.
Figure 4:
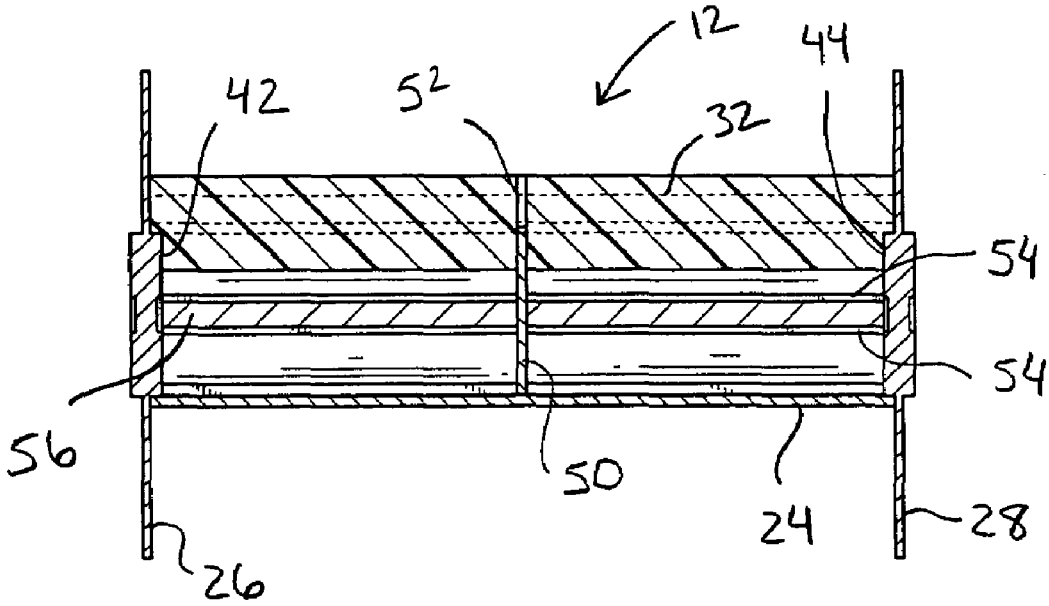
FIG. 4 is a cross sectional view of the take up reel of FIG. 2 taken along lines 4—4.
Figure 5:
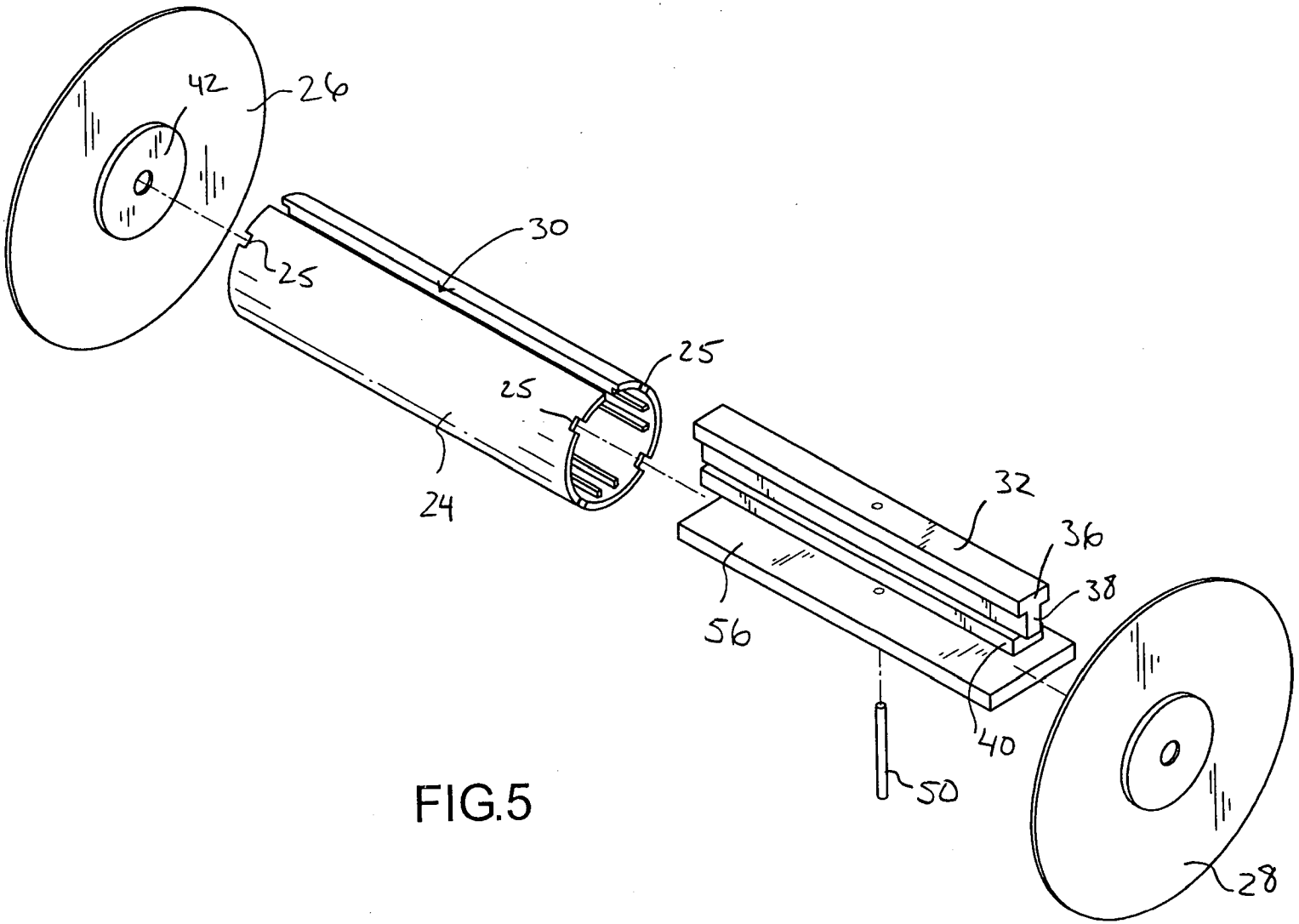
FIG. 5 is an exploded view of the take up reel of FIG. 2.

As illustrated in FIG. 2, foil 18 is wound over a core 24, having ends 26 and 28 that help keep foil 18 generally aligned as it is received on take up reel 12. Conveniently, core 24 may include recesses 25 that may be used to receive one or more pins 27 (see FIG. 3), detents or the like on ends 26 and 28. This helps to insure that ends 26 and 28 will rotate along with core 24. Also referring to FIGS. 3–5, core 24 includes a slot 30 (see FIG. 5) through which a slider 32 is movable. As explained hereinafter, slider 32 is movable between an extended position and a home position to facilitate removal of foil 18 from core 24. As illustrated in FIGS. 2 and 3, slider 32 is in the extended position—a position used when foil 18 is being wound on take up reel 12. As best illustrated in FIG. 5, slider 32 comprises a foil contacting section 36, a slot section 38 and an interior section 40. Section 36 is used to engage foil 18 and to keep it away from core 24 in the region of slot 30 (see FIG. 3). Slot section 38 is received within slot 30 and slides within slot 30 as slider 32 moves between the extended and home positions. Interior section 40 remains within the interior of core 24 and serves as a stop to prevent further travel of slider 32 once it reaches the extended position.

Slider 32 is held in the extended position by ends 26 and 28. As illustrated in FIG. 5, interior section 40 is recessed relative to slot section 38. This permits cylindrical extensions 42 and 44 on ends 26 and 28 to slide underneath slot section 38 when slider 24 is in the extended position (see FIG. 4). In this way, slider 32 is held in the extended position when ends 26 and 28 are coupled to core 24. To hold slider 32 in the extended position while reel 24 is being assembled, a pin 50 may be used. A bore 52 is provided in slider 24 to permit slider 24 to move over pin 50. Although slider 32 may slide over bore 52, sufficient friction is provided so that slider 32 may remain in the extended position while ends 26 and 28 are being coupled to core 24. When needed, slider 32 may be moved to the home position by removing ends 26 and 28 and moving slider 32 into core 24. In so doing, slider 32 moves over pin 50.

The interior of core 24 further includes pairs of rails 54 for holding a spacer 56. Spacer 56 may be used in cases where slot 30 extends the full length of core 24 to maintain the proper spacing of slot 30. For example, when foil 18 is wound around core 24, the compressive forces may tend to close slot 30 and bind core 24 against slider 32. Spacer 56 maintains the proper spacing so that slider 32 may be through slot 30. Also, pin 50 may pass through spacer 56 which serves to hold pin 50 in place.

Core 24 and spacer 56 may be constructed of essentially any type of rigid material, including aluminum, hard plastics, such as PVC, nylon, metals and the like. Slider 32 may be constructed from essentially any type of rigid material, such as hard plastics, Delrin™, nylon, metals, aluminum and the like.

Figure 6:
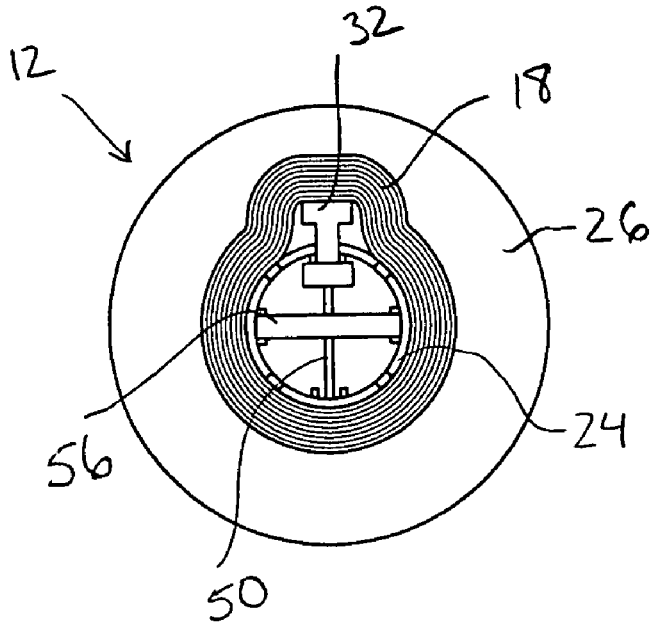
FIG. 6 is an end view of the reel of FIG. 3 with a slider member in an extended position.
Figure 7:
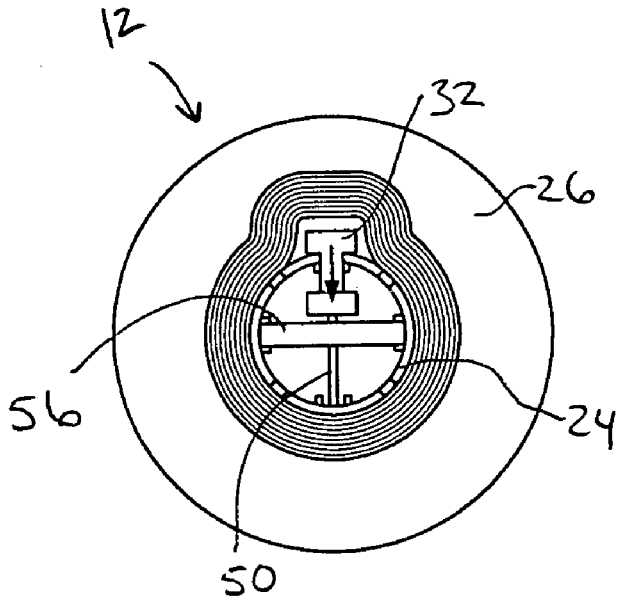
FIG. 7 illustrates the reel of FIG. 6 with the slider member moved to a home position.

Referring now to FIGS. 6 and 7, operation of reel 12 will be described further. In FIG. 6, slider 32 is in the extended position. An amount of foil 18 has been wound around core 24. As shown, the foil 18 in the region of slider 32 is spaced apart from core 24. When it is desired to remove foil 18 from reel 12, ends 26 and 28 are removed, causing slider 32 to move to the home position as shown in FIG. 7. In so doing, slider 32 moves down pin 50. When slider 32 is out of contact with foil 18, the foil surrounding core 24 relaxes, greatly reducing the compressive forces around the core 18. In this way, the wound foil 18 may be slid off of coil 24 without damaging or destroying core 24.

To re-use reel 12, slider 24 may be moved back to the extended position, with pin 50 holding it in place. Ends 26 and 28 are then pushed into place with extensions 42 and 44 being press fit into core 24. Reel 12 may then be connected to the tipping machine.

The invention has been described in detail for purposes of clarity and understanding. However, it will be appreciated that certain changes and modifications may be practiced within the scope of the appended claims.

What is claimed is:

1. A take up reel, comprising:

a core having a generally open interior and an outer surface that is adapted to hold a sheet-like material that is wound around the core, wherein the core defines at least one slot;

a slider member that is slidable within the slot between a home position and an extended position away from the outer surface, wherein when the sheet-like material is wound around the outer surface of the core when the slider member is in the extended position, the sheet-like material is spaced apart from the core in the region of the slot, and wherein when the slider member is moved to the home position, tension in the wound sheet-like material is reduced to facilitate removal of the core; and a pair of ends coupled to the core, wherein each of the ends includes an extension that extends into the interior and holds the slider member in the extended position when the end is coupled to the core, and wherein the slider member is movable to the home position when the ends are uncoupled from the core.

2. A reel as in claim 1, further comprising a spacer extending across the interior of the core, the spacer maintaining the slot in a desired orientation.

3. A reel as in claim 1, further comprising a pin and a hole formed in the slider member, wherein the pin extends into the hole and across the interior to hold the slider member in a desired orientation.

4. A reel as in claim 1, wherein the slider member comprises a nylon block.

5. A reel as in claim 1, wherein the core has ends with at least one notch, and wherein the end members include detents that fit within the notch when the end members are coupled to the core.

6. A reel as in claim 1, wherein the core comprises a cylindrical member.

7. A reel as in claim 1, wherein the sheet-like material comprises a foil.

8. A foil tipping machine, comprising:

a foil reel containing a length of foil;

a tipping module that is configured to take a card and transfer foil from the length of foil onto the card;

a take up reel that is adapted to receive the length of foil from the tipping module, wherein the take up reel comprises:

a core having a generally open interior and an outer surface that is adapted to hold the length of foil that is wound around the core, wherein the core defines at least one slot;

a slider member that is slidable within the slot between a home position and an extended position away from the outer surface, wherein when the length of foil is wound around the outer surface of the core when the slider member is in the extended position, the length of foil is spaced apart from the core in the region of the slot, and wherein when the slider member is moved to the home position, tension in the wound length of foil is reduced to facilitate removal of the core; and a pair of ends coupled to the core, wherein each of the ends includes an extension that extends into the interior and holds the slider member in the extended position when the end is coupled to the core, and wherein the slider member is movable to the home position when the ends are uncoupled from the core.

9. A machine as in claim 8, further comprising a spacer extending across the interior of the core, the spacer maintaining the slot in a desired orientation.

10. A machine as in claim 8, wherein the slider member comprises a nylon block, and further comprising a pin and a hole formed in the slider member, wherein the pin extends into the hole and across the interior to hold the slider member in a desired orientation.

11. A machine as in claim 8, further comprising a cutter to cut the length of foil prior to reaching the take up reel.

12. A machine as in claim 8, wherein the core has ends with at least one notch, and wherein the end members include detents that fit within the notch when the end members are coupled to the core.

13. A machine as in claim 8, wherein the core comprises a cylindrical member.

14. A machine as in claim 8, wherein the sheet-like material comprises a foil.

15. A method for winding a sheet-like material on a take up reel and then removing the sheet-like material from-the reel, the method comprising:

providing a reel comprising a core having a generally open interior and an outer surface, wherein the core defines at least one slot, and a slider member that is slidable within the slot between a home position and an extended position away from the outer surface;

coupling a pair of end members to the core, with each end member having an extension that holds the slider member in the extended position;

winding the sheet-like material around the core while the slider member is in the extended position, with the sheet-like material being spaced apart from the core in the region of the slot;

moving the slider member to the home position to release tension in the wound sheet-like material; and removing the sheet-like material from the core.

16. A method as in claim 15, further comprising removing the end members prior to removing the sheet-like material from the core to permit the slider member to move to the home position.

17. A method as in claim 15, further comprising maintaining a desired spacing in the slot with a spacer disposed in the interior of the core.

18. A method as in claim 15, further comprising sliding the slider member over a pin that is positioned in the interior of the core.

19. A method as in claim 15, further comprising cutting the sheet-like material before being wound onto the take up reel.

20. A method as in claim 15, further comprising feeding the sheet-like material from a holding reel.

21. A method as in claim 15, further comprising transferring foil from the sheet-like material to a card prior to winding the sheet-like material around the core.

* * * * *